United States Patent [19]

Hooper

[11] Patent Number: 4,755,798

[45] Date of Patent: Jul. 5, 1988

[54] CIRCUIT FOR CONTROLLING A DISPLAY PANEL

[75] Inventor: William P. Hooper, Largo, Fla.

[73] Assignee: Square D Company, Palatine, Ill.

[21] Appl. No.: 858,640

[22] Filed: May 2, 1986

[51] Int. Cl.[4] ..... G08B 25/00

[52] U.S. Cl. ..... 340/520; 340/52 F

[58] Field of Search ..... 340/520, 525, 52 F, 340/679, 52 R, 672

[56] References Cited

U.S. PATENT DOCUMENTS

| | | | |
|---|---|---|---|
| 3,872,473 | 3/1975 | Melgaard et al. | 340/520 |
| 3,960,011 | 6/1976 | Renz et al. | 340/520 |
| 4,223,303 | 9/1980 | Hocking | 340/520 |
| 4,443,784 | 4/1984 | Franzen et al. | 340/520 |
| 4,489,305 | 12/1984 | Lang et al. | 340/52 R |

FOREIGN PATENT DOCUMENTS

| | | | |
|---|---|---|---|
| 2059654 | 4/1981 | United Kingdom | 340/52 F |

OTHER PUBLICATIONS

Joe Davis, Circuit Indicates First Fault.

Paul C. Donatelli, A Microprocessor Based Fault Finder, Conference Record of Industry Applications Society IEEE, 1981 Meeting, Phila., PA.

*Primary Examiner*—Stewart J. Levy

*Assistant Examiner*—Hezron E. Williams

*Attorney, Agent, or Firm*—Donald P. Reynolds; A. Sidney Johnston; Richard T. Guttman

[57] ABSTRACT

A circuit for controlling a display panel identifying malfunctions in an engine generator receives a plurality of electrical signals from the engine generator, each of which identifies a particular trouble. The electrical signal may be produced by closing a switch. It is caused to operate a latch that lights a light associated with the particular malfunction. Indications of other malfunctions are suppressed until the circuit is reset. A manual reset tests all lights and then leaves them off ready to respond. A power-up reset does not test lights but leaves all lights off ready to respond. The circuit is rendered especially appropriate for military use by hardening against radiation and against pulses of electromagnetic interference.

4 Claims, 2 Drawing Sheets

CIRCUIT FOR CONTROLLING A DISPLAY PANEL

BACKGROUND OF THE INVENTION

This invention relates to display panels. In particular, it is an electronic circuit for a display panel that is particularly adapted to unattended military engine-generator sets.

Engine-generator sets may be used as principal sources of electrical energy in areas that are remote from power lines or they may be used as standby sources to supplement distribution systems in the case of outages. In either of these situations, it will often be desirable to have an engine generator operate unattended. Such an engine-generator set may either start and run automatically in response to an outage, or it may be started manually and left to run unattended.

A problem arises when an engine-generator set has shut down for one reason or another. Some of the reasons that might call for such a shutdown include electrical overloads, excessive voltage transients, or frequency instability. The engine may run low on fuel, overheat, lose speed control, develop low oil pressure, or the like. Whenever any of these events occurs, it is desirable to shut down the engine generator.

After a shutdown, it will be necessary to assure that the trouble or troubles that caused the shutdown have been cleared or repaired. This will normally require a visit to the site by an operator. The process of troubleshooting is facilitated by having some form of display device that indicates the existence of problems. However, it should be evident that by the time an operator arrives at a stopped engine generator there may be a number of troubles, many of which were caused by an initial trouble. Thus, a short circuit might cause the engine generator to be stopped as a result of an overload. Once the engine generator has stopped, its terminal voltage will go to zero, its frequency will go to zero, the oil pressure in the engine will go to zero, and there may be other associated trouble indications. It is desirable to have a means of notifying the operator which trouble came first and to suppress indications of what came later. This will enable the operator to clear the first trouble and attempt to restore the engine generator to operation. If the system has additional troubles when he does this, his attention should be called to the next disabling trouble. This will enable the operator to clear troubles in sequence until the system is restored to operation.

When an engine generator is designed for military use, an additional factor must be taken into consideration. This is the necessity of rendering the system resistant to various forms of radiation and to electromagnetic interference. This is also referred to as hardening. The circuit for control of status displays in a remote engine generator must exhibit an appropriate amount of resistance to prompt gamma rays, which is an extremely dense burst over a period of the order of tens or hundreds of nanoseconds. The circuit must be resistant to a given total dose of gamma radiation. It must withstand a given flux of neutrons. It must not be affected by alpha and beta particles. Finally, it must withstand exposure to a certain level of electromagnetic pulses.

SUMMARY OF THE INVENTION

It is an object of the present invention to provide a display panel for a remote engine generator that gives a visual indication of the first cause of an interruption of service.

It is a further object of the present invention to provide an indicating display panel for an engine generator that is resistant to various forms of radiation.

Other objects will become apparent in the course of a detailed description of the invention.

A circuit for controlling a display panel identifying malfunctions in an engine generator receives a plurality of electrical signals from the engine generator, each of which identifies a particular trouble. The electrical signal, which may be produced by closing a switch, is caused to operate a latch that lights a light associated with the particular malfunction. Indications of other malfunctions are suppressed until the circuit is reset. A manual reset tests all lights and then leaves them off ready to respond. A power-up reset does not test lights but leaves all lights off ready to respond. The circuit is rendered especially appropriate for military use by hardening against radiation and against pulses of electromagnetic interference.

DETAILED DESCRIPTION OF THE INVENTION

Figure 1:
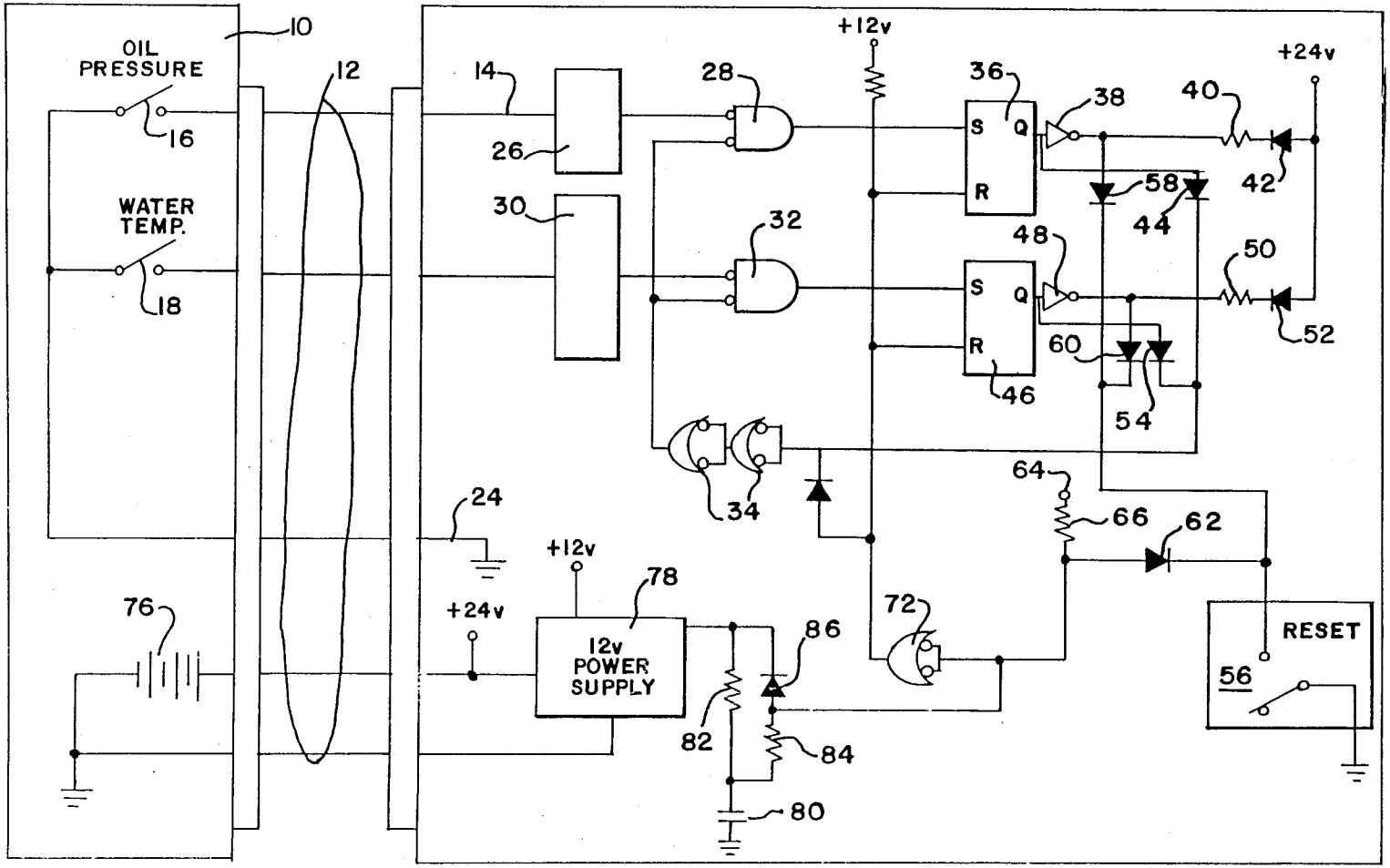
FIG. 1 is a block diagram of a circuit for the practice of the present invention with two inputs.

FIG. 1 is a block of diagram of a circuit for the practice of the present invention. In FIG. 1 engine generator 10 is connected by cables 12 to control panel 14. Engine generator 10 includes a switch 16 that responds to one trouble in engine generator 10 and a switch 18 which responds to a different trouble. Only two such switches are shown here, but it will be made evident later that the invention could be practiced with a larger number of switches. Switches 16 and 18 could also comprise sensors of any kind that produce a logical signal usable by the circuit as an indication of a malfunction.

When switch 16 is closed, a connection is made through cable 12 to ground 24 in control panel 14. This couples a logical low signal through EMI (electromagnetic interference) filter 26 to one input of NAND gate 28. A corresponding low signal from switch 18 is coupled through EMI filter 30 and is taken as one input to NAND gate 32. It should be evident that a logical high could equally as well be used to indicate trouble; this is a matter of design choice.

Filters 26 and 30 are placed in the circuit as a part of a hardening process, to protect the circuit against damage or interference from external electromagnetic fields and from radiation. Both NAND gates 28 and 32 receive inputs from the output of NAND gate 34 which supplies an inhibit signal, the origin of which will be described later. An output from NAND gate 28 is taken to a set terminal of latch 36. The output of latch 36 is taken through inverter 38 and resistor 40, then trough LED (light-emitting diode) 42 to an unregulated voltage source, typically 24 volts. LED 42 is energized when latch 36 is set, applying a ground or logical low at the output of inverter 38. The logical high from the output of latch 36 is also coupled through diode 44 to supply both inputs to NAND gate 34. This logical high will produce a logical high at the doubly inverted output of NAND gate 34, inhibiting NAND gate 28 and 32. However latch 36 is already on so LED 42 will continue to be energized, indicating the presence of the trouble that caused closure of switch 16.

When NAND gates 28 and 32 receive a low signal from NAND gate 34 so that they are enabled, or armed, a process similar to that just described can take place upon closure of switch 18. Thus, NAND gate 32 will generate an output, operating latch 46. An output from latch 46 is inverted in inverter 48 to apply a ground or a logical low at one end of resistor 50. This will apply a voltage across LED 52, causing it to light. The logical latch high will also be coupled through diode 54 to NAND gate 34, applying an inhibit signal to NAND gates 28 and 32. LED 52 will stay lighted until latch 46 is reset.

A manual reset is initiated by closing switch 56. This applies an electrical ground through diode 58 to light LED 42 and it applies an electrical ground through diodes 60 to light LED 52. As long as switch 56 is in a reset position, both LEDs 42 and 52 will stay lighted, enabling an operator to note that they work. The ground from reset switch 56 also causes diode 62 to conduct. Before this the positive voltage at terminal 64 has been coupled through resistor 66 to appear at the anode of diode 62. Operating the reset switch 56 applies a low level to the input of inverter 72 through diode 62. The high output of inverter 72 immediately resets latches 36 and 46 and, after a slight delay, caused by NAND gate 34, disables NAND gates 28 and 32. The resetting scenario of the latches requires this special timing consideration. The result is that LEDs 42 and 52 will go out and latches 36 and 46 will be reset, ready for the next trouble indication.

The circuit of FIG. 1 is powered from a battery 76 in engine generator 10, typically a 24-volt battery. This supplies the operating voltage for LEDs 42 and 52 and the charging voltage at terminal 64, and also is taken to a low-voltage power supply 78. In addition to supplying an operating low voltage, low-voltage power supply 78 generates a power-on reset signal by charging capacitor 80 through resistor 82. When power supply 78 is first turned on and capacitor 80 is uncharged, a ground or logical low is coupled through resistor 84 to the input of inverter 72. As before, this will reset latches 36 and 46 and will produce an inhibit signal from NAND gate 34. Over a period of time, determined primarily by the time constant of resistor 82 and capacitor 80, the voltage on capacitor 80 will increase until it reaches the level of a logical high input to inverter 72. This will produce a low output that will arm latches 36 and 46 and NAND gates 28 and 32 through NAND gate 34. This is a power-on reset, typically set to require about one-quarter second. A diode 86 discharges capacitor 80 through resistor 84 when power supply 78 is turned off. This causes a power-on reset whenever there is a significant interruption of power to power supply 78.

Figure 2:
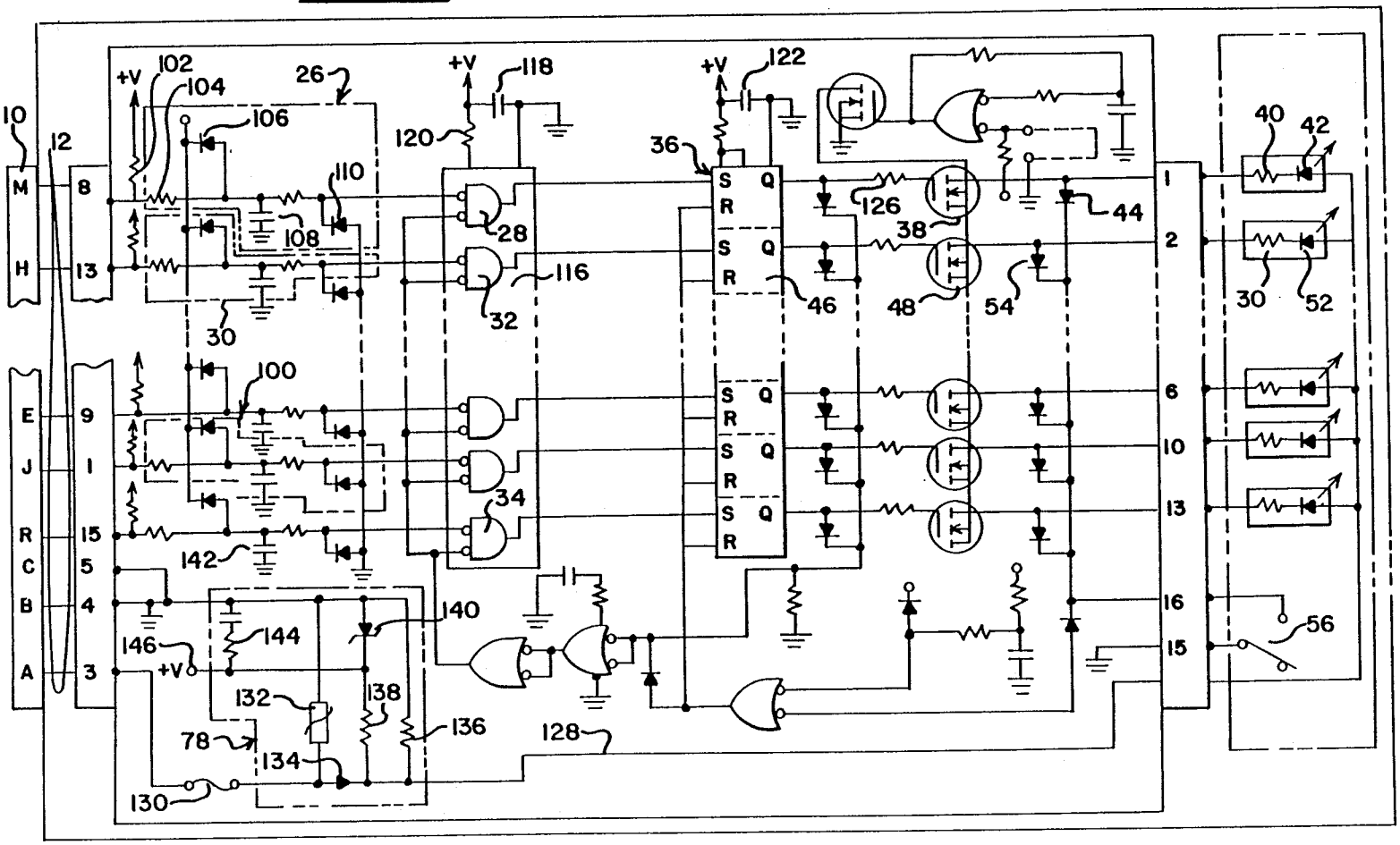
FIG. 2 is a detailed circuit diagram of a circuit for extending the circuit of FIG. 1 to an indefinite number of trouble indications.

FIG. 2 is a detailed circuit diagram indicating the components and values of some of the items that are shown schematically in FIG. 1. Where FIG. 1 showed two trouble inputs, FIG. 2 shows the first two and the last of what were eleven separate indications, each with its own panel light, in a circuit that was build for the practice of the invention. Those trouble indications are as follows: Overload, Reverse power, Short circuit, Low coolant, Undervoltage, Overvoltage, No fuel, Low oil pressure, High temperature, Overspeed, and Water in fuel. Each of these has its own sensor in engine generator 10 and each sensor will apply a short circuit when the particular condition occurs. If a particular sensor in engine generator 10 caused an open circuit instead of a short circuit on the existence of trouble, this would require an extra stage of logical inversion for that sensor. In FIG. 2 EMI filters 26 and 30 are the same as those of FIG. 1 and EMI filter 100 of FIG. 2 is that of the last sensing line in cable 12. Omitted sensing lines and their associated components are indicated symbolically. In FIG. 2 repeated components will be described once for purposes of clarity. A resistor 102 supplies a pull-up voltage at the input to EMI filter 26. Diode 106 connects the signal line to the voltage source to bypass to the voltage source any externally induced voltage pulse. Capacitor 108 is connected to ground to serve as a noise filter. Diode 110 bypasses received negative pulses to ground and resistor 112 is a current-limiting resistor that both limits the current resulting from electromagnetic pulses and also protects diode 110 against the damage that would otherwise result from high current flow when diode 110 is briefly rendered a short circuit by a short, intense dose of prompt gamma rays. Resistor 104 similarly provides protection for diode 106. Each of the elements of filter 26 that has just been described has its identical counterpart in EMI filters 30 and 100 and those that are not shown in any other such lines that are used to respond to sensors in engine generator 10.

The signal on line 114 is now taken as one input to NAND gate 28 which along with NAND gate 32 is shown as one element of an integrated circuit 116. The operating voltage supply for integrated circuit 116 is given additional filtering by capacitor 118. To protect integrated circuit 116 against the dump of stored energy in capacitor 118 that would result from exposure to prompt gamma rays, resistor 120 is connected in series with the supply to integrated circuit 116. Latch 36 is similarly protected by capacitor 122 and resistor 124. The output of latch 36 is taken to inverter 38 through resistor 126. This limits current flow through inverter 38, typically a field-effect transistor, which is also caused to become a short circuit for a brief interval upon exposure to prompt gamma rays. The functions of diodes 44 and 58, resistor 40 and LED 42 are identical to those that have been described in FIG. 1. Thus, a short circuit in engine-generator 10 that is applied through EMI filter 26, line 114, NAND gate 28, latch 36, resistor 126, inverter 38, and resistor 40 to LED 42 will produce a visible indication that a short circuit has been applied by the sensor in engine generator 10.

FIG. 2 includes more details of low-voltage power supply 78 which receives an input of the order of 24 volts on line 128 from engine-generator 10. Current on line 128 passes through fuse 130. A metal-oxide varistor (MOV) 132 that is connected to ground protects the line against surges. Current next passes through diode 134 and terminal 64, then to low-voltage power supply 78.

In low-voltage power supply 78, resistor 136 is connected from the high voltage to ground. Resistor 138 drops the high voltage, nominally 24 volts, to an appropriate supply level for the integrated circuits. That voltage here is nominally 12 volts and is determined by Zener diode 140. Filter capacitor 142 is protected against radiation-induced dump by series resistor 144. The dropped and filtered output at terminal 146 is taken to components of the circuit that require 12 volts.

The principal technique used to harden the circuit of FIG. 2 to withstand a given dose of neutron bombardment is the use of complimentary metal-oxide semiconductors (CMOS) and metal-oxide semiconductor field-effect transistors (MOSFET) in preference to bipolar transistors. Thus, the circuit of FIG. 2 contains no bipolar transistors. The components of FIG. 2 in a version of the circuit that has been built and tested are listed by element number in the Table.

TABLE

COMPONENTS AND ELEMENT VALUES IN FIG. 2

| RESISTORS Values in Ohms | | CAPACITORS Values in Microfarads | | INTEGRATED CIRCUITS |
|---|---|---|---|---|
| Element | Value | Element | Value | Element Description |
| 40 | 1.3K | 80 | 6.8 | 28 CD4001 QUAD NOR GATE |
| 50 | 1.3K | 108 | 0.1 | 32 CD4001 QUAD NOR GATE |
| 66 | 4.7K | 118 | 0.1 | 34 CD4001 QUAD NOR GATE |
| 82 | 100K | 122 | 0.1 | 36 CD4043 QUAD NOR R-S LATCH |
| 84 | 4.7K | 142 | 100 | |
| 102 | 10K | | | |
| 104 | 4.7K | | | |
| 112 | 4.7K | | | |
| 120 | 330 | | | |
| 124 | 330 | | | |
| 126 | 330 | | | |
| 136 | 3K | | | |
| 138 | 560 | | | |
| 144 | 10 | | | |

SEMICONDUCTORS

| | |
|---|---|
| 38 | IRFD123 MOSFET |
| 42 | LED |
| 44 | IN4148 Diode |
| 48 | IRFD123 MOSFET |
| 52 | LED |
| 54 | IN4148 Diode |
| 58 | IN4148 Diode |
| 60 | IN4148 Diode |
| 62 | IN4148 Diode |
| 72 | IRFD123 MOSFET |
| 74 | IRFD123 MOSFET |
| 86 | IN4148 Diode |

TABLE-continued

COMPONENTS AND ELEMENT VALUES IN FIG. 2

| | |
|---|---|
| 106 | IN4148 Diode |
| 110 | IN4148 Diode |
| 130 | Fuse 1A.25O V |
| 132 | MOV |
| 134 | IN4005 Diode |
| 140 | IN4742 Zener |

We claim:

1. A circuit for producing an indication of a malfunction in a device such as an engine generator that includes a plurality of sensors producing logical signals in response to malfunctions, the circuit comprising:

a. a plurality of EMI filters, each one of the EMI filters including a back-biased diode connected to a ground, a back-biased diode connected to a voltage source, and a series current-limiting resistor, each one of the EMI filters connected to receive one of the logical signals produced in response to malfunctions, each of the EMI filters producing a filtered logical signal;

b. a plurality of gates, one of the gates connected to each of the EMI filters to receive the filtered logical signal and produce from it a gated logical signal;

c. a plurality of latches, one of the latches connected to each of the gates to set a latch in response to a gated logical signal;

d. means for inhibiting each of the plurality of gates when a latch is set; and e. means for indicating when the latch is set.

2. The circuit of claim 1 comprising in addition means for resetting each of the plurality of latches manually after a latch has been set.

3. The circuit of claim 1 comprising in addition means for resetting each of the plurality of latches on power-up unless the latch is receiving a signal indicating a malfunction.

4. The circuit of claim 1 wherein the means for indicating when the latch is set comprises a light-emitting diode (LED).

* * * * *